US011072987B2

(12) United States Patent
Cridland et al.

(10) Patent No.: US 11,072,987 B2
(45) Date of Patent: Jul. 27, 2021

(54) RUNNING TOOL ASSEMBLIES AND METHODS

(71) Applicant: CAMERON INTERNATIONAL CORPORATION, Houston, TX (US)

(72) Inventors: Robert Cridland, Leeds (GB); Gavin Robottom, Leeds (GB)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 357 days.

(21) Appl. No.: 15/853,402

(22) Filed: Dec. 22, 2017

(65) Prior Publication Data

US 2018/0187502 A1 Jul. 5, 2018

Related U.S. Application Data

(60) Provisional application No. 62/440,762, filed on Dec. 30, 2016.

(51) Int. Cl.
*E21B 33/04* (2006.01)
*E21B 23/10* (2006.01)

(52) U.S. Cl.
CPC ..... *E21B 23/10* (2013.01); *E21B 33/0415* (2013.01)

(58) Field of Classification Search
CPC combination set(s) only.
See application file for complete search history.

(56) References Cited

U.S. PATENT DOCUMENTS 4,067,388 A * 1/1978 Mouret ..... E21B 23/04 166/208
4,496,172 A 1/1985 Walker
4,697,828 A 10/1987 Chou
5,735,344 A 4/1998 Duncan
6,401,827 B1 6/2002 Ferguson et al.
(Continued)

FOREIGN PATENT DOCUMENTS

WO 2005068775 A1 7/2005
WO 2016106176 A2 6/2016

OTHER PUBLICATIONS

International Search Report and Written Opinion dated Apr. 13, 2018, for International Application No. PCT/US2017/068315 (16 pgs.).

(Continued)

*Primary Examiner* — Cathleen R Hutchins
*Assistant Examiner* — Ronald R Runyan
(74) *Attorney, Agent, or Firm* — Helene Raybaud

(57) ABSTRACT

A running tool assembly for installing a hanger in a wellhead housing includes a first body configured to support the hanger, a second body coupled to the first body, a piston moveable relative to the second body, wherein the piston includes a first position and a second position spaced from the first position, and a piston chamber formed in the running tool assembly, wherein, when the assembly is coupled to the hanger and the hanger is positioned in the wellhead housing, the piston is configured to actuate from the first position to the second position in response to a pressurization of the piston chamber to engage a locking member disposed about the hanger and thereby lock the hanger to the wellhead housing, the assembly including a passage having a diameter that is equal to or larger in size than a diameter of a passage of the hanger.

17 Claims, 13 Drawing Sheets

(56) References Cited

U.S. PATENT DOCUMENTS

| | | | |
|---|---|---|---|
| 2010/0084136 | A1 | 4/2010 | Travis et al. |
| 2012/0292035 | A1 | 11/2012 | Fenwick |
| 2014/0166298 | A1 | 6/2014 | Fenwick |
| 2015/0252635 | A1 | 9/2015 | Hartley et al. |
| 2016/0186502 | A1 | 6/2016 | Nguyen |

OTHER PUBLICATIONS

International Preliminary Report on Patentability issued in the PCT Application PCT/US2017/068315, dated Jul. 2, 2019 (12 pages).
The Extended European Search Report issued in EP Application 17887132.3, dated Aug. 5, 2020 (6 pages).

* cited by examiner

RUNNING TOOL ASSEMBLIES AND METHODS

CROSS-REFERENCE TO RELATED APPLICATIONS

This application claims benefit of U.S. provisional patent application Ser. No. 62/440,762 filed Dec. 30, 2016, and entitled "Running Tool Assemblies and Methods," which is hereby incorporated herein by reference in its entirety.

STATEMENT REGARDING FEDERALLY SPONSORED RESEARCH OR DEVELOPMENT

Not applicable.

BACKGROUND

Hydrocarbon well systems require various components to access and extract hydrocarbons from subterranean earthen formations. Such systems may include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly.

In some applications, a hanger, such as a tubing hanger, is installed in the wellhead assembly via a running tool releasably coupled to the tubing hanger. The tubing hanger and running tool may be lowered towards the wellhead via a tubular string until the hanger is landed within the wellhead. In some applications, the running tool may also transport seal assemblies, locking members, and other accoutrements of the tubing hanger for installation within the wellhead for sealing and securing the tubing hanger therein. Additionally, the tubing hanger may include passages for the running of control lines downhole to control components and monitor conditions in a wellbore of the well system.

SUMMARY

An embodiment of a running tool assembly for installing a tubing or casing hanger in a wellhead housing comprises a first body configured to support the tubing or casing hanger, a second body releasably coupled to the first body, an actuation piston axially moveable relative to the second body, wherein the piston comprises a first position and a second position axially spaced from the first position, and a piston chamber formed in the running tool assembly, wherein, when the running tool assembly is coupled to the tubing or casing hanger and the hanger is positioned in the wellhead housing, the actuation piston is configured to actuate from the first position to the second position in response to a pressurization of the piston chamber to engage a locking member disposed about the tubing or casing hanger and thereby lock the tubing or casing hanger to the wellhead housing, wherein the running tool assembly comprises a central passage having a minimum diameter that is equal to or larger in size than a minimum diameter of a central passage of the tubing or casing hanger. In some embodiments, the first body comprises an inner body configured to couple with a conveyance string configured to transport the running tool assembly, and the second body comprises an outer body disposed about the inner body. In some embodiments, the running tool assembly further comprises an actuation flange coupled to the outer surface of the outer body, wherein the actuation piston comprises a radially inwards extending flange that includes a seal in sealing engagement with the outer surface of the outer body, wherein the piston chamber is formed between a lower end of the actuation flange and the flange of the actuation piston. In certain embodiments, the running tool assembly further comprises an actuation passage extending through the outer body and in fluid communication with the piston chamber, wherein the actuation passage is configured to receive pressurized fluid from an actuation control line to actuate the actuation piston from the first position to the second position. In certain embodiments, the running tool assembly further comprises a control line flange coupled to the inner body, wherein the control line flange is configured to releasably couple to the tubing or casing hanger. In some embodiments, the running tool assembly further comprises a locking member disposed in a receptacle of the control line flange, wherein the locking member comprises a first position restricting relative axial movement between the control line sub and the outer body and a second position allowing relative axial movement between the control line sub and the outer body. In some embodiments, the outer body is configured to displace the locking member from the first position to the second position in response to relative axial movement between the inner body and the outer body. In some embodiments, the running tool assembly further comprises a control line stab connector housed in the running tool assembly, wherein, when the running tool assembly is coupled to the tubing or casing hanger, the running tool assembly is configured to transmit control signals between a first control line coupled to the running tool assembly and a second control line coupled to the tubing or casing hanger via the control line stab connector.

An embodiment of a running tool assembly for installing a tubing or casing hanger in a wellhead housing comprises a first body configured to support the tubing or casing hanger, a second body releasably coupled to the first body, a control line stab connector housed in the running tool assembly, an actuation piston axially moveable relative to the second body, wherein the piston comprises a first position and a second position axially spaced from the first position, and a piston chamber formed in the running tool assembly, wherein, when the running tool assembly is coupled to the tubing or casing hanger and the hanger is positioned in the wellhead housing, the actuation piston is configured to actuate from the first position to the second position in response to a pressurization of the piston chamber to engage a locking member disposed about the tubing or casing hanger and thereby lock the tubing or casing hanger to the wellhead housing, wherein, when the running tool assembly is coupled to the tubing or casing hanger, the running tool assembly is configured to transmit control signals between a first control line coupled to the running tool assembly and a second control line coupled to the tubing or casing hanger via the control line stab connector. In some embodiments, the control line stab connector comprises a male stab connector coupled to the second body, and a female stab connector coupled to the control line sub, wherein the male and female stab connectors are configured to connect and form a signal connection therebetween in response to the application of an axial load to one of the male or female stab connectors. In some embodiments, the second body comprises a control passage having a first end including a fitting configured to couple with the first control line and a second end including the male stab connector, and the control line sub comprises a control passage having a first end including the female stab connector and a second end including a fitting configured to couple with the second control line. In certain embodiments, the second body is releasably coupled to the control line sub, and in response to disconnecting the second body from the control line sub, the male stab connector of the second body is configured to disconnect from the female stab connector of the control line sub. In certain embodiments, the first body comprises an inner body configured to couple with a conveyance string configured to transport the running tool assembly, and the second body comprises an outer body disposed about the inner body. In some embodiments, the running tool assembly further comprises an actuation flange coupled to the outer surface of the outer body, wherein the actuation piston comprises a radially inwards extending flange that includes a seal in sealing engagement with the outer surface of the outer body, wherein the piston chamber is formed between a lower end of the actuation flange and the flange of the actuation piston. In some embodiments, the running tool assembly further comprises an actuation passage extending through the outer body and in fluid communication with the piston chamber, wherein the actuation passage is configured to receive pressurized fluid from an actuation control line to actuate the actuation piston from the first position to the second position. In certain embodiments, the running tool assembly comprises a central passage having a minimum diameter that is equal to or larger in size than a minimum diameter of a central passage of the tubing or casing hanger.

An embodiment of a method of installing a tubing or casing hanger in a wellhead housing comprises coupling the tubing or casing hanger to a running tool assembly, running the tubing or casing hanger into a bore of a wellhead housing, and actuating a piston of the running tool assembly from a first position to a second position axially spaced from the first position to engage a locking member disposed about the tubing or casing hanger and thereby lock the tubing or casing hanger to the wellhead housing, wherein the running tool assembly comprises a central passage having a minimum diameter that is as great or larger in size than a minimum diameter of a central passage of the tubing or casing hanger. In some embodiments, the method further comprises pressurizing an actuation control line coupled to the running tool assembly to pressurize a piston chamber of the running tool assembly and actuate the piston from the first position to the second position. In some embodiments, the method further comprises disconnecting an outer body of the running tool assembly from a control line sub of the running tool assembly, whereby disconnecting the outer body from the control line sub disconnects a male stab connector of the outer body from a female stab connector of the control line sub. In certain embodiments, the method further comprises axially displacing an inner body of the running tool assembly relative to an outer body of the running tool assembly, whereby axially displacing the inner body relative to the outer body displaces a locking member of a control line sub of the running tool assembly from a locked position to an unlocked position, permitting relative axial movement between the outer body and the control line sub.

BRIEF DESCRIPTION OF THE DRAWINGS

For a detailed description of exemplary embodiments, reference will now be made to the accompanying drawings in which.

DETAILED DESCRIPTION

Figure 1:
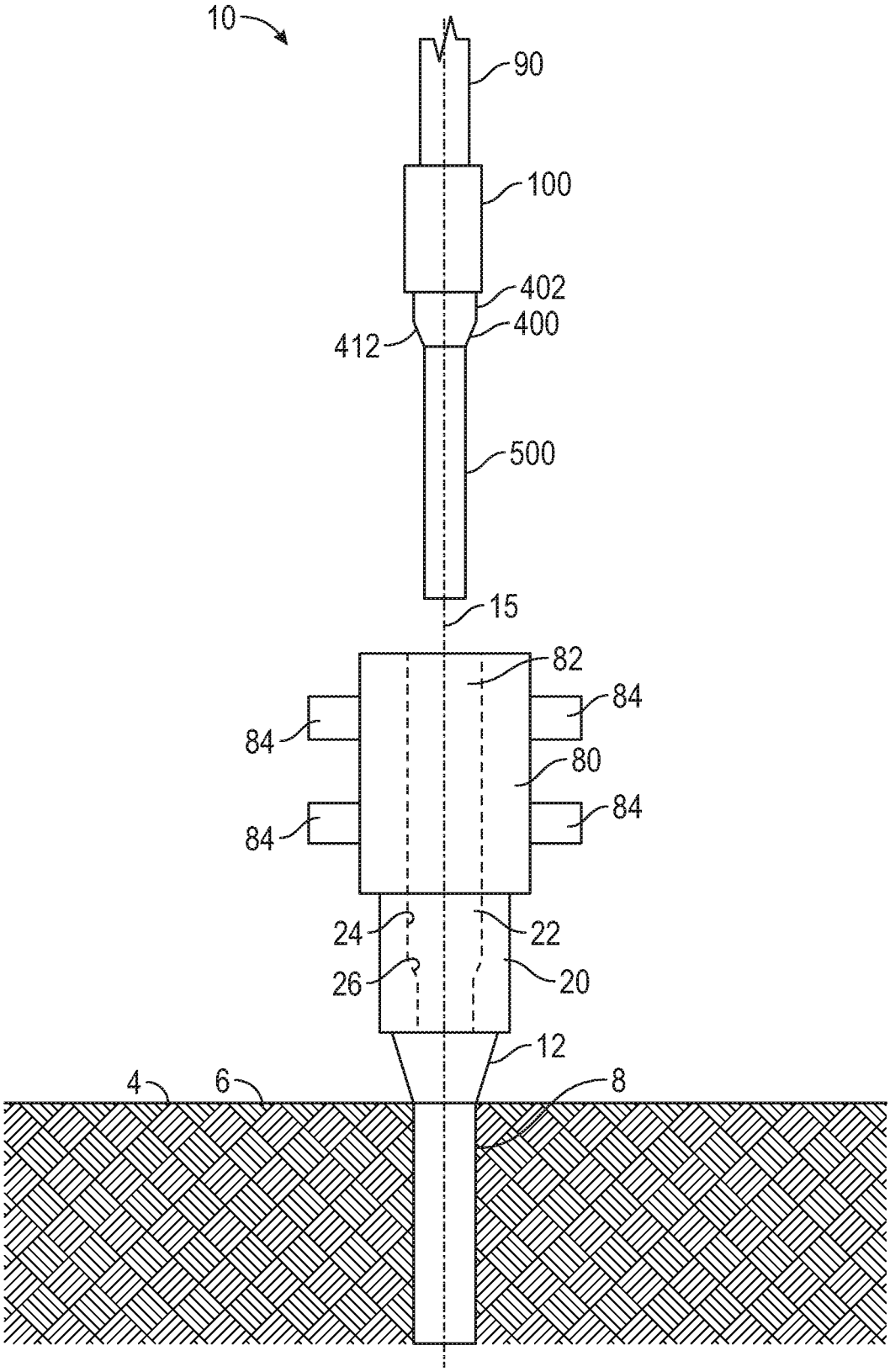
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. The well system 10 is generally configured to extract various minerals and natural resources, including hydrocarbons (e.g., oil and/or natural gas), or configured to inject substances into an earthen surface 4 and an earthen subterranean formation 6 via a well or wellbore 8. In some embodiments, the well system 10 is land-based, such that the surface 4 is land surface, or subsea, such that the surface 4 is the seal floor. In the embodiment shown in FIG. 1, well system 10 generally includes a wellhead connector or hub 12, a wellhead housing 20, a blowout preventer (BOP) 80, a conveyance tubular member or string 90, a running tool assembly 100, a tubing hanger 400, and a production string or tubing 500. For ease of description below, reference to "tubing" shall include casing and other tubulars associated with wellheads. Further, "housing" may also be referred to as "head," "spool," "receptacle," or "bowl."

In some embodiments, wellhead connector 12, housing 20, and BOP 80 comprise components of a wellhead system that typically includes multiple components that control and regulate activities and conditions associated with the wellbore 8. For example, the wellhead system generally includes bodies, valves and seals that route produced fluids from the wellbore 8, provide for regulating pressure in the wellbore 8, and provide for the injection of substances or chemicals downhole into the wellbore 8. The BOP 80 of well system 10 may include a variety of valves, fittings, and controls to prevent oil, gas, or other fluid from exiting the wellbore 8 in the event of an unintentional release of pressure or an overpressure condition, such as a plurality of actuatable rams 84 for selectably sealing a bore 82 of BOP 80.

In the embodiment shown in FIG. 1, the wellhead housing 20 provides a base for the BOP 80 and other components of system 10. Housing 20 also provides an interface for sealing and securing tubular members installed in wellbore 8, including tubing hanger 400 and production tubing 500. In the embodiment shown in FIG. 1, wellhead housing 20 includes a central bore or passage 22 defined by a generally cylindrical inner surface 24, where wellhead housing bore 22 provides for fluid communication and the passage of tools or other devices between the bore 82 of BOP 80 and the wellbore 8. In this arrangement, the bore 82 of BOP 80 and the bore 22 of wellhead housing 20 provide access to the wellbore 8 for various completion and workover procedures. For example, components can be run down to the BOP 80 and disposed in the wellhead housing bore 22 to seal off the wellbore 8, to inject fluids downhole, to suspend tools downhole, to retrieve tools downhole, and the like.

In the embodiment shown in FIG. 1, tubing hanger 400 and production tubing 500 may be installed within wellhead housing 20 via the running tool assembly 100, where production tubing 500 is coupled to, and suspended from, a lower end of the tubing hanger 400. Particularly, the running tool assembly 100, tubing hanger 400, and production tubing 500 are conveyed towards and stabbed into the bore 22 of wellhead housing 20 via conveyance string 90 for installation within the bore 22 of wellhead housing 20. In certain embodiments, conveyance string 90 and running tool assembly 100 are lowered (e.g., run) from an offshore vessel (not shown) to the wellbore 8 and/or the wellhead housing 20. In other embodiments, such as land surface systems, running tool assembly 100 (including the tubing hanger 400 and production tubing 500 coupled therewith) may be suspended over and/or lowered into the bore 22 of wellhead housing 20 via a crane or other lifting device. In the embodiment shown in FIG. 1, the inner surface 24 of wellhead housing bore 22 includes a landing or engagement shoulder 26 for engaging a corresponding landing or engagement shoulder 412 of an inner surface 402 of the tubing hanger 400. In this arrangement, tubing hanger 400 may be stabbed into the bore 22 of wellhead housing 20 until the landing shoulder 412 of tubing hanger 400 engages or lands against the landing shoulder 26 of wellhead housing 20, indicating that the tubing hanger 400 has been landed in the bore 22 of wellhead housing 20.

As will be discussed further herein, associated components of the tubing hanger 400 such as seal or packoff assemblies, locking members, etc., may be installed within wellhead housing bore 22 via running tool assembly 100 and conveyance string 90, or via additional running tool assemblies. For instance, the running tool assembly 100 is configured to apply a force and/or pressure to energize or "set" associated components of tubing hanger 400 for securing hanger 400 within the bore 22 of wellhead housing 20 following the successful landing of tubing hanger 400 within the bore 22 of wellhead housing 20. As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the well 8. For example, the tubing hanger 400 is typically disposed within the wellhead housing 20 to secure tubing and casing suspended in the wellbore 8, and to provide a path for hydraulic control fluid, chemical injections, and the like.

As will be discussed further herein, running tool assembly 100 is configured to provide an interface for the connection of one or more control lines with corresponding control lines coupled with tubing hanger 400. In this arrangement, control signals, such as hydraulic, electrical, optical, etc., signals may be passed between running tool assembly 100 and tubing hanger 400 during the installation of hanger 400 within the bore 22 of wellhead housing 20. Further, although well system 10 is shown in FIG. 1 as including BOP 80 coupled with wellhead housing 20, in other embodiments, well system 10 may include additional components coupled with either the BOP 80 and/or wellhead housing 20. Additionally, as will be discussed further herein, following the successful installation of tubing hanger 400 and production tubing 500 in wellhead housing 20, BOP 80 may be removed and a Christmas or production tree may be coupled to wellhead housing 20 to provide for the production of hydrocarbons from subterranean 6 via a production fluid flowpath extending through the production tubing 500 and the production tree coupled with wellhead housing 20. Moreover, while running tool assembly 100 is discussed herein in the context of installing tubing hanger 400 and production tubing 500, in other embodiments, running tool assembly 100 may be employed to install other devices or tools in wellhead housing 20, such as casing hangers and other tubular members.

Figure 2:
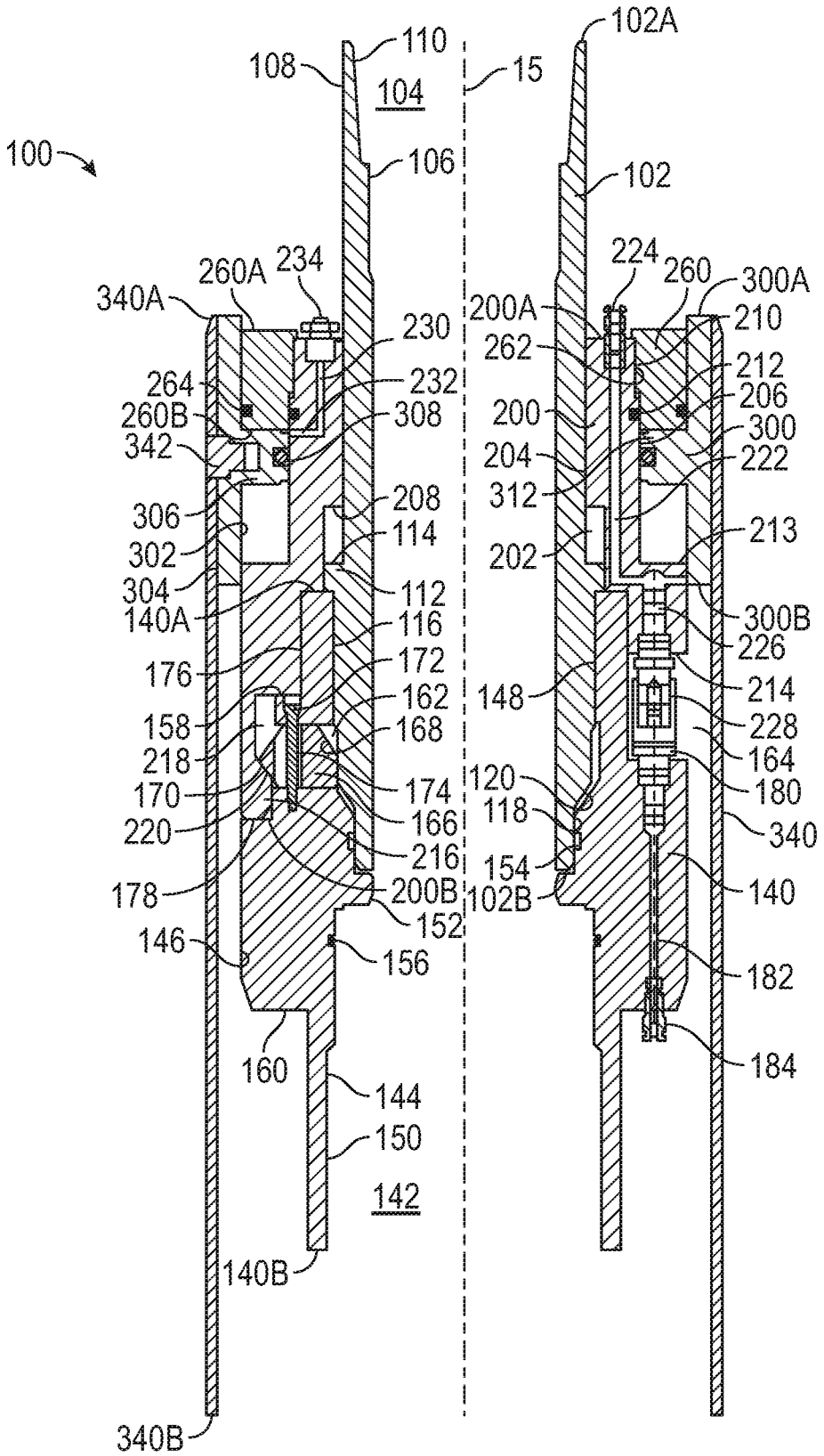
FIG. 2 is a cross-sectional view of an embodiment of a running tool assembly of the well system of FIG. 1 in accordance with principles disclosed herein.

Referring to FIGS. 1 and 2, an embodiment of running tool assembly 100 is shown in FIG. 2. In the embodiment shown in FIG. 2, running tool assembly 100 has a longitudinal or central axis disposed coaxial with longitudinal axis 15 of well system 10 and generally includes a first or inner body or tubular member 102, a control line interface or sub 140, a second or outer body or tubular member 200, an actuation member or flange 260, an actuation piston 300, and an outer sleeve or housing 340. Inner body 102 is generally configured to provide a releasable connection between the conveyance string 90 and components of running tool assembly 100.

In the embodiment shown in FIG. 2, inner body 102 of running tool assembly 100 has a first or upper end 102A, a second or lower end 102B, a central bore or passage 104 extending between ends 102A and 102B and defined by a generally cylindrical inner surface 106, and a generally cylindrical outer surface 108 extending between ends 102A and 102B. At upper end 102A the inner surface 106 of inner body 102 includes a connector 110 for releasably coupling with a lower end of conveyance string 90 shown in FIG. 1. In this embodiment, connector 110 comprises a threaded connector for threadably coupling with conveyance string 90 to form a sealed or premium tubing connection therebetween; however, in other embodiments, connector 110 of inner body 102 may comprise other releasable connecting mechanisms known in the art. In the embodiment shown in FIG. 2, the outer surface 108 of inner body 102 includes an annular flange or protrusion 112 extending radially outwards therefrom, where flange 112 forms an annular outer shoulder 114 facing the upper end 102A of inner body 102. Additionally, the outer surface 108 of inner body 102 includes an annular recess or groove 118 extending radially therein, where groove 118 extends axially between lower end 102B and an annular shoulder or profile 120 that faces lower end 102B. The outer surface 108 of inner body 102 further includes a connector 116 at lower end 102B for releasably coupling inner body 102 with control line sub 140. In the embodiment shown in FIG. 2, connector 116 comprises a threaded connector; however, in other embodiments, connector 116 may comprise other connectors known in the art for forming a releasable connection.

Referring to FIGS. 1-5C, control line sub 140 is generally configured to provide for the passage of control signals between a rig or platform from which running tool assembly 100 is suspended and tools or components downhole of tubing hanger 400 during the installation of hanger 400 and production tubing 500 in wellhead housing 20. In the embodiment shown in FIGS. 2-5C, control line sub 140 includes a first or upper end 140A, a second or lower end 140B, a central bore or passage 142 extending between ends 140A and 140B and defined by a generally cylindrical inner surface 144, and a generally cylindrical outer surface 146 extending between ends 140A and 140B. Inner surface 144 of control sub 140 includes a first or upper connector 148 for releasably coupling with connector 116 of inner body 102 and a second or lower connector 150 for releasably connecting control line sub 140 with tubing hanger 400. In the embodiment shown in FIGS. 2-5C, connectors 148 and 150 each comprise a threaded connector for threadably coupling with inner body 102 and hanger 400, respectively; however, in other embodiments, connectors 148 and 150 may comprise other releasable coupling mechanisms known in the art.

In the embodiment shown in FIGS. 2-5C, the inner surface 144 of control line sub 140 includes a radially inwards extending flange or protrusion 152 that forms an upward facing (i.e., facing upper end 140A) shoulder disposed adjacent the lower end 102B of inner body 102 when coupled therewith, and a downward facing (i.e., facing lower end 140B) disposed adjacent an upper end of tubing hanger 400 when coupled therewith. Inner surface 144 of control line sub 140 additionally includes a first or upper annular seal 154 and a second or lower annular seal 156 axially spaced from upper seal 154. Particularly, upper annular seal 154 is disposed axially between upper end 140A and flange 152 and is configured to sealingly engage the outer surface 108 of inner body 102 when inner body 102 is coupled with control line sub 140 via upper connector 148; lower annular seal 156 is disposed axially between flange 152 and lower end 140B and is configured to sealingly engage an outer surface of tubing hanger 400 when hanger 400 is coupled with control line sub 140 via lower connector 150.

Figure 3:
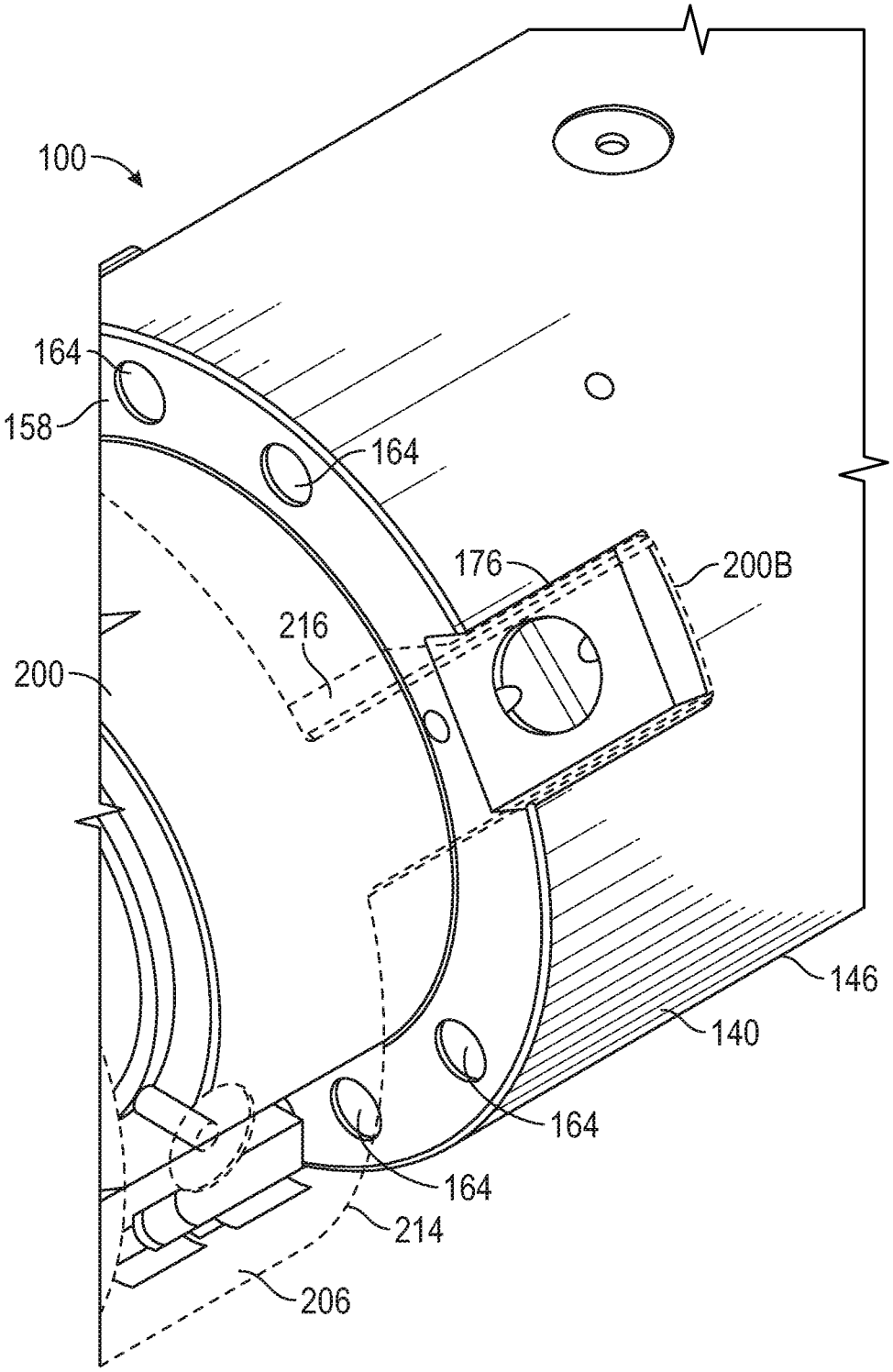
FIG. 3 is a partial perspective view of the running tool assembly of FIG. 2.
Figure 4:
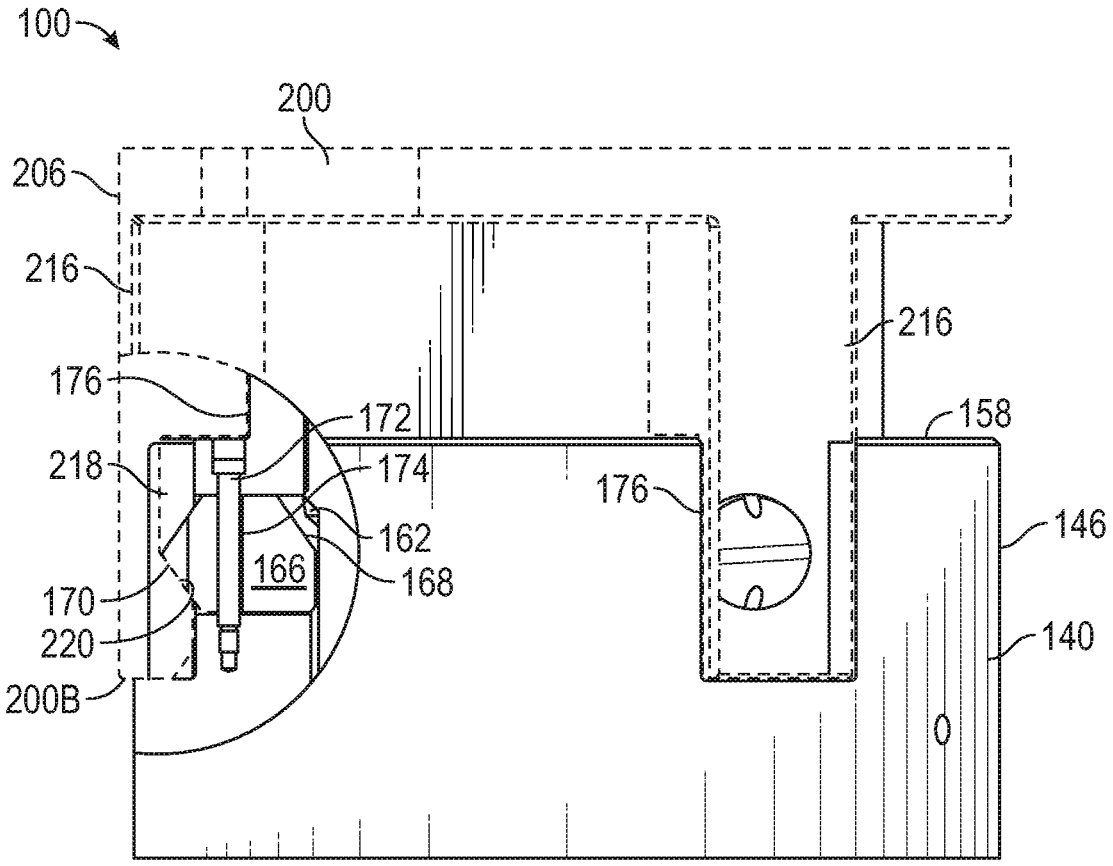
FIG. 4 is a partial side view of the running tool assembly of FIG. 2.
Figure 5A:
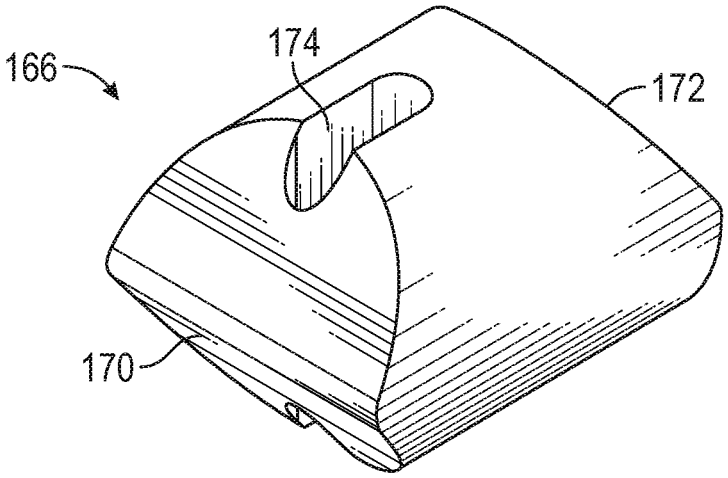
FIG. 5A is a perspective view of an embodiment of a locking member of the running tool assembly of FIG. 2 in accordance with principles disclosed herein.
Figure 5B:
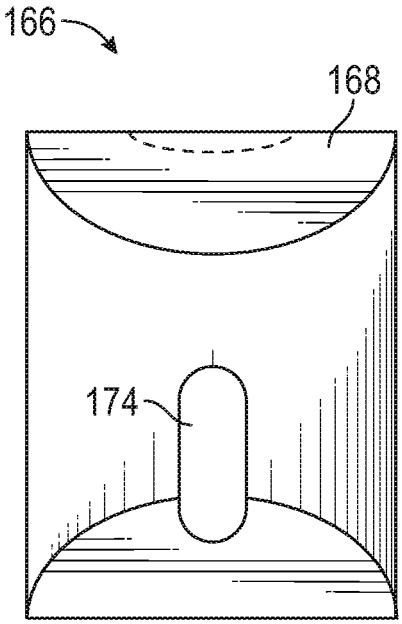
FIG. 5B is a top view of the locking member of FIG. 5A.
Figure 5C:
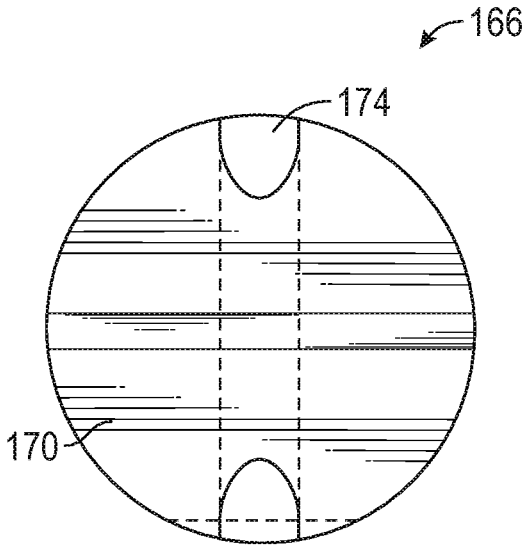
FIG. 5C is a side view of the locking member of FIG. 5A.

In the embodiment shown in FIGS. 2-5C, the outer surface 146 of control line sub 140 includes a first or upper upwards facing annular shoulder 158 and a second or lower downwards facing annular shoulder 160 axially spaced from upper shoulder 158. Disposed axially between upper shoulder 158 and lower shoulder 160 are a plurality of circumferentially spaced locking slots or receptacles 162 that extend radially between outer surface 146 and inner surface 144 of control line sub 140. Additionally, a plurality of circumferentially spaced connector receptacles 164 extend axially into control line sub 140 from upper shoulder 158, where each receptacle 164 is angularly offset or spaced from each locking slot 162. In the embodiment shown in FIGS. 2-5C, each locking slot 162 includes a radially translatable locking member or dog 166 configured to selectably restrict relative axial movement between the control line sub 140 and the outer body 200. For clarity, outer body 200 is shown in FIGS. 3 and 4 as partially transparent. Additionally, control line sub 140 is shown partially in cross-section in FIG. 4 for additional clarity.

In this embodiment, each locking dog 166 includes an angled inner surface or profile 168 and an angled outer surface or profile 170. Additionally, each locking slot 162 includes an elongate retainer or fastener 172 extending axially therethrough. Particularly, the retainer 172 of each locking dog 166 extends through a slot 174 disposed in the locking dog 166, thereby permitting limited radial movement of dog 166 within its corresponding locking slot 162 while preventing the locking dog 166 from escaping or falling out of its corresponding locking slot 162. Further, the outer surface 146 of control line sub 140 includes a plurality of circumferentially spaced orientation grooves 176 that extend axially from upper end 140A to a lower terminal end 178, where each orientation groove 176 is angularly aligned with a corresponding locking slot 162. In the embodiment shown in FIGS. 2-5C, each connector receptacle 164 of control line sub 140 houses a female stab connector 180, as will be discussed further herein. Additionally, control line sub 140 includes a plurality of control passages 182, where each passage 182 extends axially between a corresponding female connector 180 and a control fitting or interface 184 disposed in the lower shoulder 160 of control line sub 140. In the embodiment shown in FIGS. 2-5C, control fitting 184 is configured to couple with a hydraulic control line to allow for the passage of hydraulic fluid to female connector 180 via control passage 182, where female connector 180 comprises a hydraulic or fluid connector; however, in other embodiments, control fitting 184 may attach to or secure an electrical, optical, etc., control line extending through control passage 182 to female connector 180, where female connector 180 comprises an electrical, optical, etc., connector.

As will be discussed further herein, outer body 200 is generally configured to assist in the actuation of actuation piston 300 and is releasably coupled to control line sub 140 via the plurality of circumferentially spaced locking dogs 166. In the embodiment shown in FIGS. 2-5C, outer body 200 includes a first or upper end 200A, a second or lower end 200B, a central bore or passage 202 extending between ends 200A and 200B and defined by a generally cylindrical inner surface 204, and a generally cylindrical outer surface 206 extending between ends 200A and 200B. The inner surface 204 of outer body 200 includes an annular downwards facing (i.e., facing lower end 200B) inner shoulder 208. As will be discussed further herein, engagement between inner shoulder 208 of outer body 200 and the outer shoulder 114 formed by flange 112 of inner body 102 provides for the retrieval of outer body 200 during removal of running tool assembly 100. The outer surface 206 of inner body 200 includes a connector 210 for releasably coupling with actuation flange 260 and an annular seal 212 disposed therein for sealingly engaging the actuation flange 260. While in the embodiment shown in FIGS. 2-5C the inner body 200 and actuation flange 260 comprise separate, releasably coupled members, in other embodiments, inner body 200 and actuation flange 260 may comprise a single, unitary member.

In the embodiment shown in FIGS. 2-5C, the outer surface 206 of inner body 200 additionally includes an annular outer shoulder 213 for limiting the travel of actuation piston 300 during the actuation thereof. Additionally, the inner body 200 includes an annular downwards facing lower shoulder 214 and a plurality of circumferentially spaced engagement members or tabs 216 that extend axially between lower shoulder 214 and the lower end 200B of inner body 200. The inner surface 204 of each engagement tab 216 includes a locking receptacle 218 formed therein that includes an angled surface or profile 220 configured to engage the outer profile 170 of the corresponding locking dog 166 to thereby selectively restrict relative axial movement between inner body 200 and control line sub 140, as will be discussed further herein.

Additionally, each engagement tab 216 is configured to be inserted into a corresponding orientation groove 176 formed in the outer surface 146 of control line sub 140. In this arrangement, control line sub 140 may only be fitted or inserted within the bore 202 of inner body 200 in a predetermined relative angular orientation where engagement tabs 216 are permitted to be inserted into corresponding orientation grooves 176 with the terminal end (i.e., lower end 200B of inner body 200) of each engagement tab 216 contacting or disposed directly adjacent the terminal end 178 of the corresponding orientation groove 176. In this manner, engagement tabs 216 of inner body 200 and corresponding orientation grooves 176 of control line sub 140 angularly orient inner body 200 relative control line sub 140 during assembly of the running tool assembly 100.

In the embodiment shown in FIGS. 2-5C, inner body 200 includes a plurality of circumferentially spaced control passages 222 that extend axially between upper end 200A and lower shoulder 214. An upper end of each control passage 222 includes a control fitting or interface 224 while a lower end of each passage 222 includes a male stab connector 226 configured to releasably couple or stab into a corresponding female stab connector 180 of control line sub 140 to form a stab coupling or connector 228 therebetween, where stab connectors 228 may be made up or formed in response to an axial load applied to either of the stab connectors 180 or 226. In this arrangement, male connector 226 extends axially from the lower shoulder 214 of inner body 200. In the embodiment shown in FIGS. 2-5C, control fitting 224 is configured to couple with a hydraulic control line to allow for the passage of hydraulic fluid to male connector 226 via control passage 222, where male stab connectors 226 comprise hydraulic or fluid connectors and stab connectors 228 comprises a hydraulic or fluid connection; however, in other embodiments, control fitting 224 may attach to or secure an electrical control line extending through control passage 222 to male connectors 226, where male connectors 226 comprise an electrical connector and stab connector 228 comprises an electrical connection. In still further embodiments, stab connectors 228 may comprise other connections configured for the passage of control signals, such as optical or acoustic connections. Although in this embodiment outer body 200 includes male stab connectors 226 while control line sub 140 includes female stab connectors 180, in other embodiments, outer body 200 may include female stab connectors 180 while control line sub 140 includes male stab connectors 226. In this embodiment, inner body 200 additionally includes an actuation passage 230 extending between upper end 200A and a radial port 232 disposed in the outer surface 206 of inner body 200. An upper end of actuation passage 230 includes a control fitting or interface 234 for coupling with a hydraulic control line, thereby allowing for the selective pressurization of radial port 232.

Actuation flange 260 is generally configured to assist in the actuation of actuation piston 300, as will be described further herein. In the embodiment shown in FIGS. 2-5C, actuation flange 260 is generally cylindrical and includes a first or upper end 260A and a second or lower end 260B. As described above, actuation flange 260 is releasably coupled with inner body 200 in the embodiment shown in FIGS. 2-5C. Particularly, an annular inner surface of actuation flange 260 includes a connector 262 for releasably coupling with the connector 210 of inner body 200. In the embodiment shown in FIGS. 2-5C, connectors 210 and 262 comprise threaded connectors for forming a threaded connection between inner body 200 and actuation flange 260; however, in other embodiments, connectors 210 and 262 may comprise other connectors known in the art configured to provide a releasable connection. Actuation flange 260 additionally includes an annular seal 264 in an outer surface of flange 260 for sealingly engaging actuation piston 300. In this arrangement, seal 212 of inner body 200 restricts fluid communication between inner body 200 and actuation flange 260 while seal 264 of actuation flange 260 restricts fluid communication between actuation flange 260 and actuation piston 300.

Actuation piston 300 is configured to be actuated to assist (along with outer sleeve 340) in setting or actuating components associated with tubing hanger 400 during the installation of hanger 400 and production tubing 500 in the wellhead housing 20. In the embodiment shown in FIGS. 2-5C, actuation piston is generally cylindrical and includes a first or upper end 300A, a second or lower end 300B, a central bore or passage extending between ends 300A and 300B and defined by a generally cylindrical inner surface 302, and a generally cylindrical outer surface 304 extending between ends 300A and 300B. The inner surface 302 of actuation piston 300 includes a radially inwards extending annular flange 306 including an annular seal 308 disposed therein that sealingly engages the outer surface 206 of inner body 200. Actuation piston 300 is in sliding engagement with inner body 200, and thus, may move axially relative inner body 200 between a first or upper position (shown in FIG. 2) where an upper shoulder of flange 306 is disposed directly adjacent lower end 260B of actuation flange 260 and a second or lower position where a lower shoulder of flange 306 is disposed directly adjacent outer shoulder 213 of inner body 200. In this configuration, the sealing engagement provided by seals 212, 264, and 308 define an actuation or piston chamber 312 in fluid communication with the radial port 232 of inner body 200.

In the embodiment shown in FIGS. 2-5C, outer sleeve 340 is generally cylindrical and includes a first or upper end 340A, a second or lower end 340B, and one or more circumferentially spaced keys 342 that extend radially between the outer sleeve 340 and actuation piston 300 to couple or lock the outer sleeve 340 to the actuation piston 300. As will be discussed further herein, the lower end 340B of outer sleeve 340 is configured to engage and actuate components associated with tubing hanger 400 to assist in the installation of tubing hanger 400 and production tubing 500 in wellhead housing 20; however, in other embodiments, outer sleeve 340 may be used to perform various functions in wellhead housing 20 beyond assisting the installation of tubing hanger 400.

Referring to FIGS. 1, 2, and 6-12, in the embodiment shown in FIGS. 6-12, wellhead housing 20 includes a casing hanger or spool 380 installed within the bore 22 of housing 20, where casing hanger 380 includes an angled landing shoulder or profile 382 configured to position tubing hanger 400 within bore 22 of wellhead housing 20 during installation of tubing hanger 400 therein. In this embodiment, the landing shoulder 382 of casing hanger 380 comprises the landing shoulder 26 shown in FIG. 1; however, in other embodiments, tubing hanger 400 may land against a shoulder of wellhead housing 20 itself, or against landing shoulders of other members disposed in the bore 22 of wellhead housing 20. In the embodiment shown in FIGS. 6-12, a riser and BOP assembly 85 is stacked on top of or coupled to an upper end 20A of wellhead housing 20. Riser and BOP assembly 85 includes a riser 87 releasably coupled to the upper end 20A of wellhead housing 20 and BOP 80 (not shown in FIGS. 6-12) coupled to the upper end of riser 87. As shown in FIGS. 6-12, bore 82 extends through riser 87 of riser and BOP assembly 85. Additionally, in this embodiment, tubing hanger 400 is generally cylindrical and includes a first or upper end 400A, the central bore 402 defined by a generally cylindrical inner surface 404 that extends from upper end 400A, and a generally cylindrical outer surface 406 also extending from upper end 400A.

In the embodiment shown in FIGS. 6-12, the bore 104 of inner body 102 and a portion of the bore 142 of control line sub 140 defined by flange 152 comprise a central bore or passage 390 of running tool assembly 100 through which fluid, tools, tubular members, or other devices may be communicated to the bore 402 of tubing hanger 400. Running tool assembly 100 is configured such that a minimum diameter $D_{390}$ (shown in FIG. 6) of the bore 390 of running tool assembly 100 is equal to or greater in size than a minimum diameter $D_{402}$ (shown in FIG. 6) of the bore 402 of tubing hanger 400. In this configuration, running tool assembly 100 is configured to provide full bore access to tubing hanger 400 and production tubing 500 such that tools having an outer diameter substantially equal to the minimum diameter $D_{402}$ of the bore 402 of tubing hanger 400 may be conveyed through the bore 390 of running tool assembly 100. Such tools may include, without limitation, packers, back-pressure valves, and other devices, such as devices configured to seal against the inner surface 404 of tubing hanger 400 or an inner surface of production tubing 500.

The outer surface 406 of tubing hanger 400 includes a connector 408 for releasably connecting with the lower connector 150 of control line sub 140. In the embodiment shown in FIGS. 6-12, connector 408 comprises a threaded connector for threadably connecting with the lower connector 150 of sub 140; however, in other embodiments, connector 408 of tubing hanger 400 may comprise other connectors in the art configured for providing a releasable connection. Additionally, the outer surface 406 of tubing hanger 400 includes one or more circumferentially spaced coupling members 410 configured to selectively restrict relative rotation between tubing hanger 400 and control line sub 140. In the embodiment shown in FIGS. 6-12, coupling members 410 comprise threaded fasteners; however, in other embodiments, coupling members 410 may require other release couplers or connectors known in the art. Outer surface 406 of tubing hanger 400 also includes an angled landing shoulder or profile 412 configured to matingly engage the landing shoulder 382 of casing hanger 380 to properly position tubing hanger 400 within the bore 22 of wellhead housing 20 during the landing and installation of tubing hanger 400 therein.

In the embodiment shown in FIGS. 6-12, tubing hanger 400 includes a plurality of circumferentially spaced control passages 414 extending therethrough and associated control fittings or interfaces 416. In the embodiment shown in FIGS. 6-12, control fittings 416 are configured to couple with hydraulic control lines 418 to allow for the passage of hydraulic control fluid through control passage 414 for controlling components or tools disposed downhole of tubing hanger 400 as well as other components or tools disposed in wellhead housing 20; however, in other embodiments, control fittings 416 may be configured to couple to or retain electrical, optical, or acoustic signal carriers or cables to allow for the passage of electrical, optical, or acoustic signals through tubing hanger 400.

In the embodiment shown in FIGS. 6-12, tubing hanger 400 includes a generally annular locking member or lock ring 420 disposed about the outer surface 406 thereof that includes a first or radially inner position (shown in FIG. 6) permitting relative axial movement between tubing hanger 400 and wellhead housing 20, and a second or radially outer position disposed in a locking groove 28 formed in the inner surface 24 of wellhead housing 20 that restricts relative axial movement between tubing hanger 400 and wellhead housing 20. Tubing hanger 400 additionally includes an actuation or friction ring 422 configured to actuate the lock ring 420 from the inner unlocked position to the outer locked position. Particularly, friction ring 422 is engaged by the lower end 340B of the outer sleeve 340 of running tool assembly 100, and in response to downward (i.e., in the direction of casing hanger 380) axial movement of outer sleeve 340, is shifted axially downwards and thereby actuates lock ring 420 into the outer locked position.

As briefly described above, conveyance string 90 and running tool assembly 100 may be used to install tubing hanger 400 and production tubing 500 in wellhead housing 20 as part of a completion operation to prepare well system 10 for the production of hydrocarbons from the subterranean formation 6. As shown particularly in FIG. 6, running tool assembly 100 is coupled with conveyance string 90 and tubing hanger 400, while production tubing 500 is coupled with and suspended from tubing hanger 400. Particularly, in the embodiment shown in FIGS. 6-12, the connector 110 of the inner body 102 of running tool assembly 100 is threadably connected with a threaded connector 92 disposed at the lower end of conveyance string 90; however, in other embodiments, conveyance string 90 and running tool assembly 100 may be releasably connected using other mechanisms known in the art. Running tool assembly 100, hanger 400, and production tubing 500 (not shown in FIGS. 6-12) are then lowered towards and into bore 22 of wellhead housing 20 until the landing shoulder 412 of tubing hanger 400 engages and seats against the landing shoulder 382 of casing hanger 380, thereby axially locating tubing hanger 400 within wellhead housing 20.

As tubing hanger 400 is run into the bore 22 of wellhead housing 20, and following landing of hanger 400 therein, control signals may be transmitted from a rig or platform from which conveyance string 90 is suspended to components of hanger 400, tubing 500, or other components or tools downhole of tubing 500 or disposed in wellhead housing 20, via one or more first or running tool control lines 430 coupled with running tool assembly 100. Particularly, control signals transmitted through running tool control lines 430 may be communicated to the second or hanger control lines 418 of tubing hanger 400 (as well as other control lines in signal communication with control lines 418 via the stab connection formed between female connector 180 and male connector 226 that form the stab connector 228 of running tool assembly 100. Moreover, control signals may be communicated or passed between running tool control lines 430 and the control lines 418 of tubing hanger 400 before, during, and after the actuation of lock ring 420 and friction ring 422, as will be discussed further herein.

Figure 6:
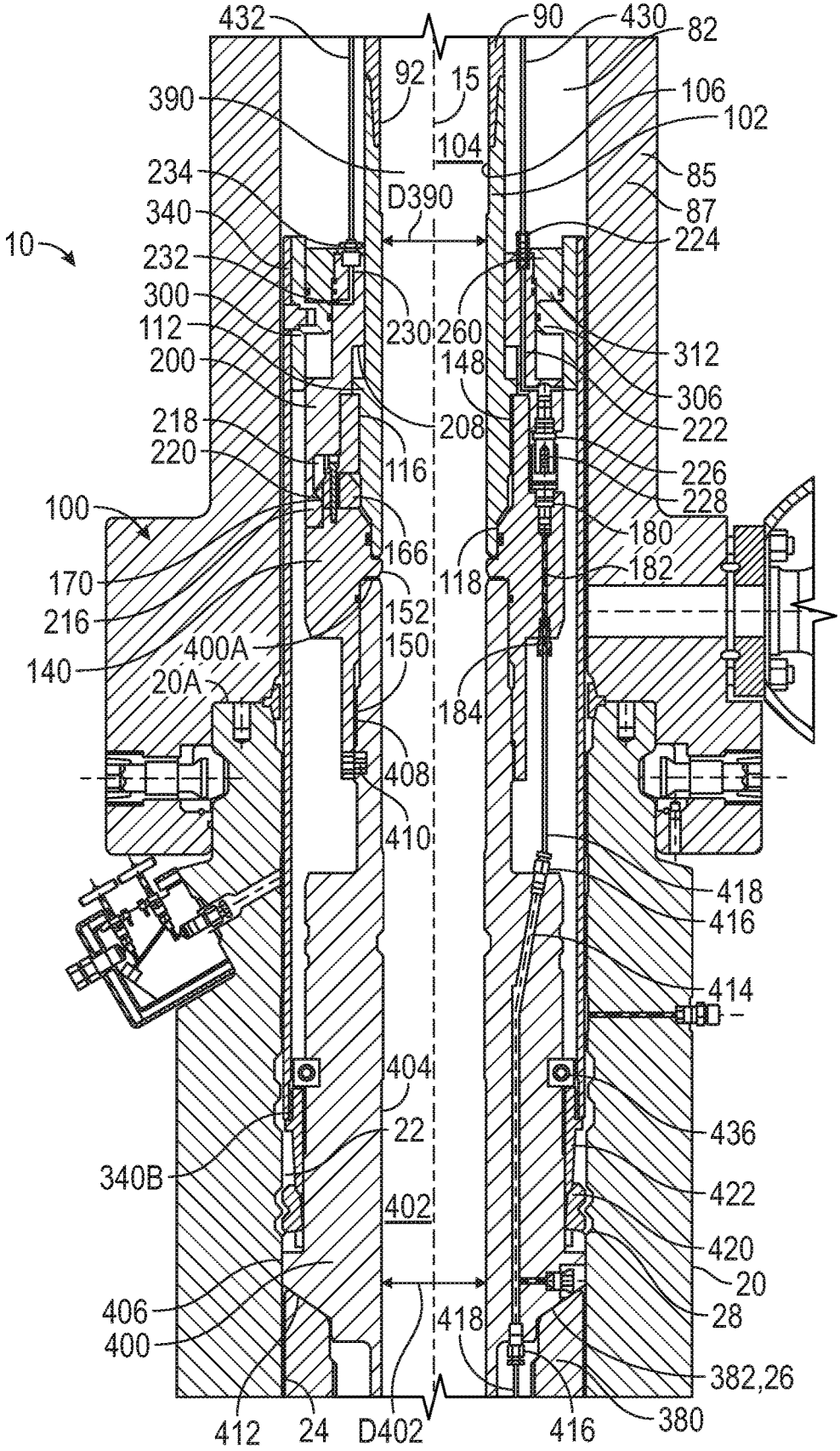
FIG. 6 is a cross-sectional view of the running tool assembly of FIG. 2 shown in a first position in an embodiment of a wellhead assembly of the well system of FIG. 1 in accordance with principles disclosed herein.

As shown particularly in FIG. 6, as tubing hanger 400 and production tubing 500 are run into the bore 22 of wellhead housing 20, actuation piston 300 is in the upper position described above and each locking dog 166 is disposed in a first or radially outer locked position within the corresponding locking slot 162 of control line sub 140 thereby restricting relative axial movement between control line sub 140 and outer body 200. Particularly, when locking dogs 166 are in the locked position the outer profile 170 of each dog 166 is in mating engagement with the profile 220 of a corresponding engagement tab 216 of outer body 200, thereby restricting relative axial movement between control line sub 140 and outer body 200. Additionally, during the running and landing of tubing hanger 400, inner body 102 is in a first or lower position relative outer body 200 (forming an axial gap between outer shoulder 114 of inner body 102 and inner shoulder 208 of outer body 200), where groove 118 is axially offset from locking dogs 166 of control line sub 140, thereby preventing locking dogs 160 from being displaced or actuated radially inwards into a second or radially inner unlocked position allowing for relative axial movement between control line sub 140 and outer body 200.

Figure 7:
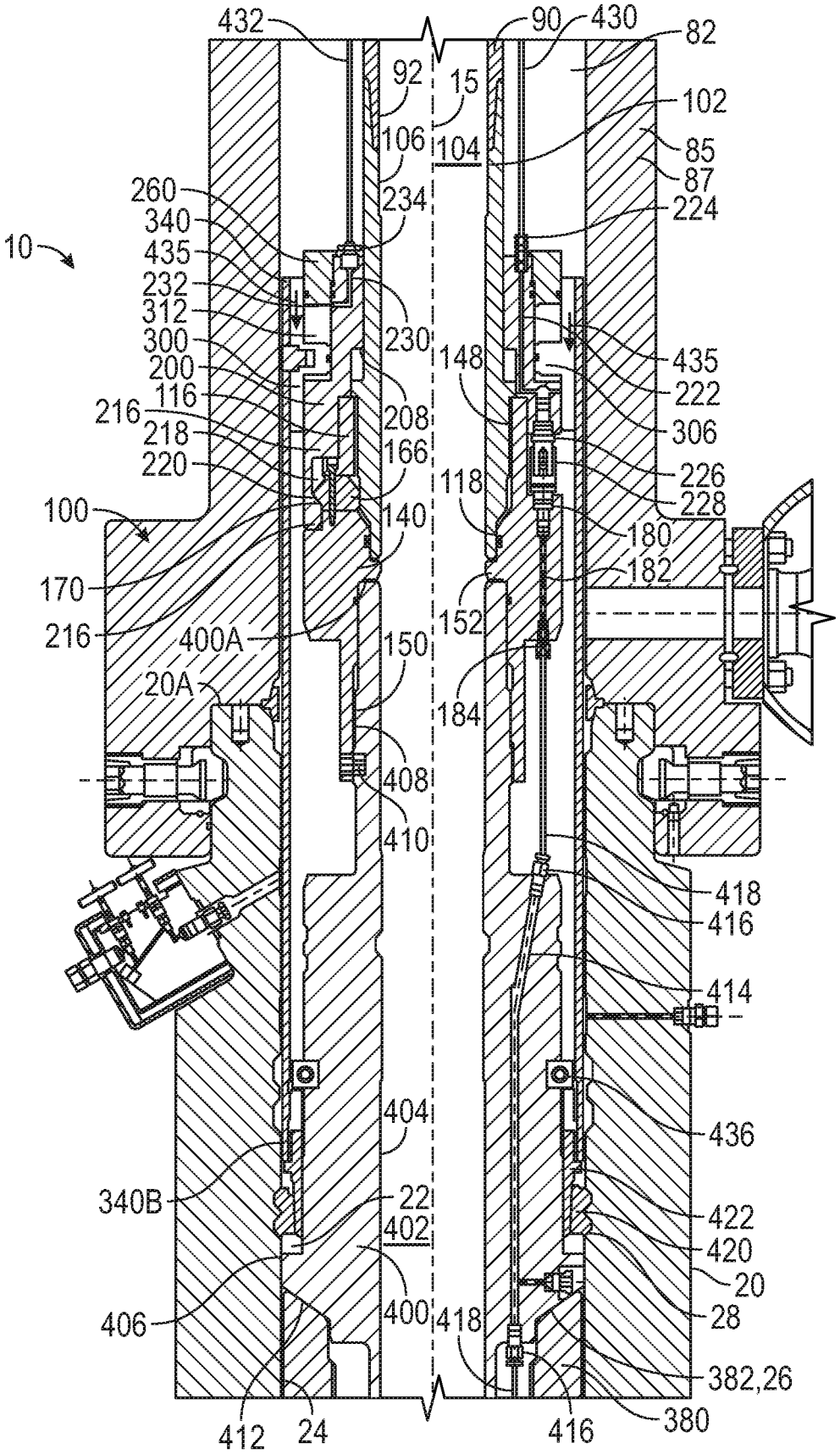
FIG. 7 is a cross-sectional view of the running tool assembly of FIG. 2 shown in a second position in the wellhead assembly of the well system of FIG. 1.

As shown particularly in FIG. 7, once tubing hanger 400 and accompanying production tubing 500 are landed in wellhead housing 20, running tool assembly 100 may be used to actuate lock ring 420 into the locked position to thereby lock tubing hanger 400 within wellhead housing 20 such that relative movement between tubing hanger 400 and wellhead housing 20 is restricted. In the embodiment shown in FIGS. 6-12, pressurized hydraulic fluid is supplied to piston chamber 312 through radial port 232 via an actuation control line 432 coupled to control fitting 234. In this configuration, the pressurized fluid in piston chamber 312 applies an axially directed pressure force or load (indicated by arrows 435 in FIG. 7) against the lower end 260B of actuation flange 260 and the upper shoulder of the flange 306 of actuation piston 300. Given that actuation flange 260 is coupled to outer body 200 via connector 210 of body 200 and connector 262 of flange 260, and thus cannot be displaced axially relative outer body 200, the pressure force applied by the pressurized fluid in piston chamber 312 displaces actuation piston 300 downwards towards a second or lower position where a lower shoulder of flange 306 contacts or is disposed directly adjacent outer shoulder 213 of outer body 200.

Outer sleeve 340, which is coupled to actuation piston 300 via the one or more keys 342, is also displaced downwards by the pressurization of piston chamber 312, and thereby engages friction ring 422 via lower end 340B to shift friction ring 422 axially downwards to correspondingly actuate lock ring 420 into the outer locked position. Once lock ring 420 is actuated into the outer locked position and tubing hanger 400 is thereby locked within bore 22 of wellhead housing 20, additional components or tools such as packers, back-pressure valves, and the like, may be conveyed through the bore 390 of running tool assembly 100 installed within or downhole of tubing hanger 400. Given that bore 390 of running tool assembly 100 provides full bore access to tubing hanger 400 and production tubing 500, such tools conveyed through bore 390 may include an outer diameter substantially equal to the minimum diameter $D_{402}$ (shown in FIG. 6) of the bore 402 of tubing hanger 400.

Figure 8:
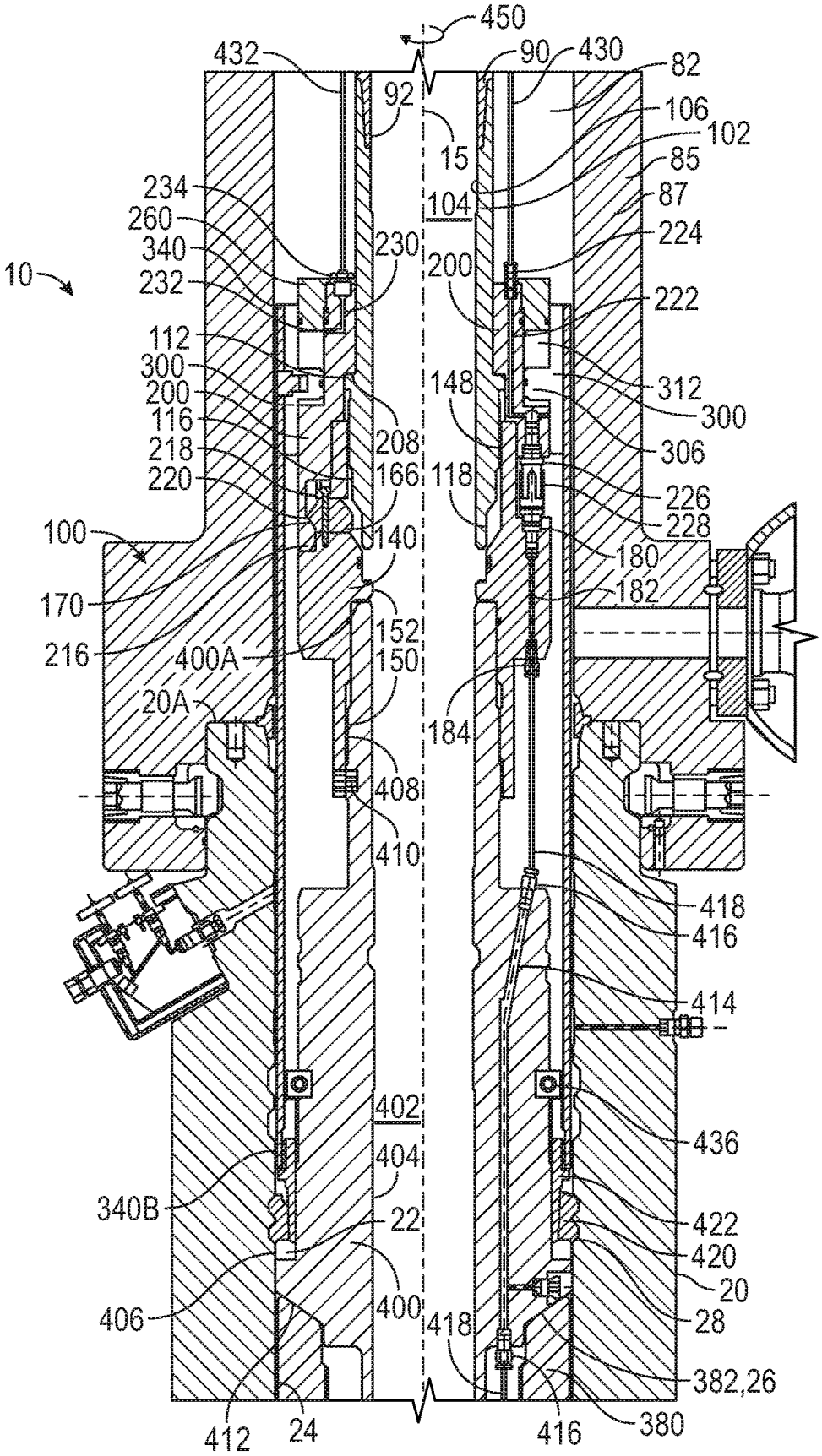
FIG. 8 is a cross-sectional view of the running tool assembly of FIG. 2 shown in a third position in the wellhead assembly of the well system of FIG. 1.
Figure 9:
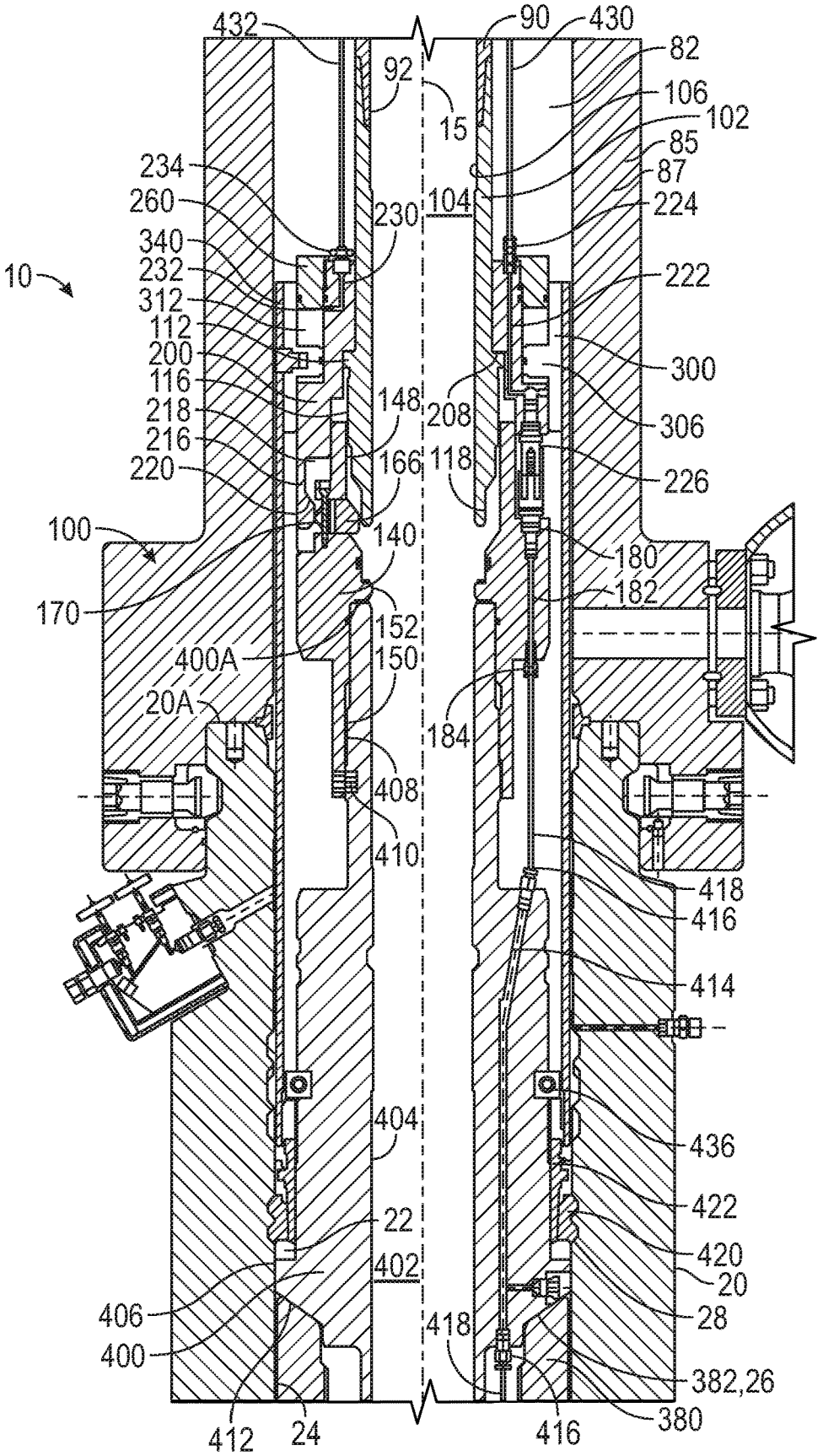
FIG. 9 is a cross-sectional view of the running tool assembly of FIG. 2 shown in a fourth position in the wellhead assembly of the well system of FIG. 1.
Figure 10:
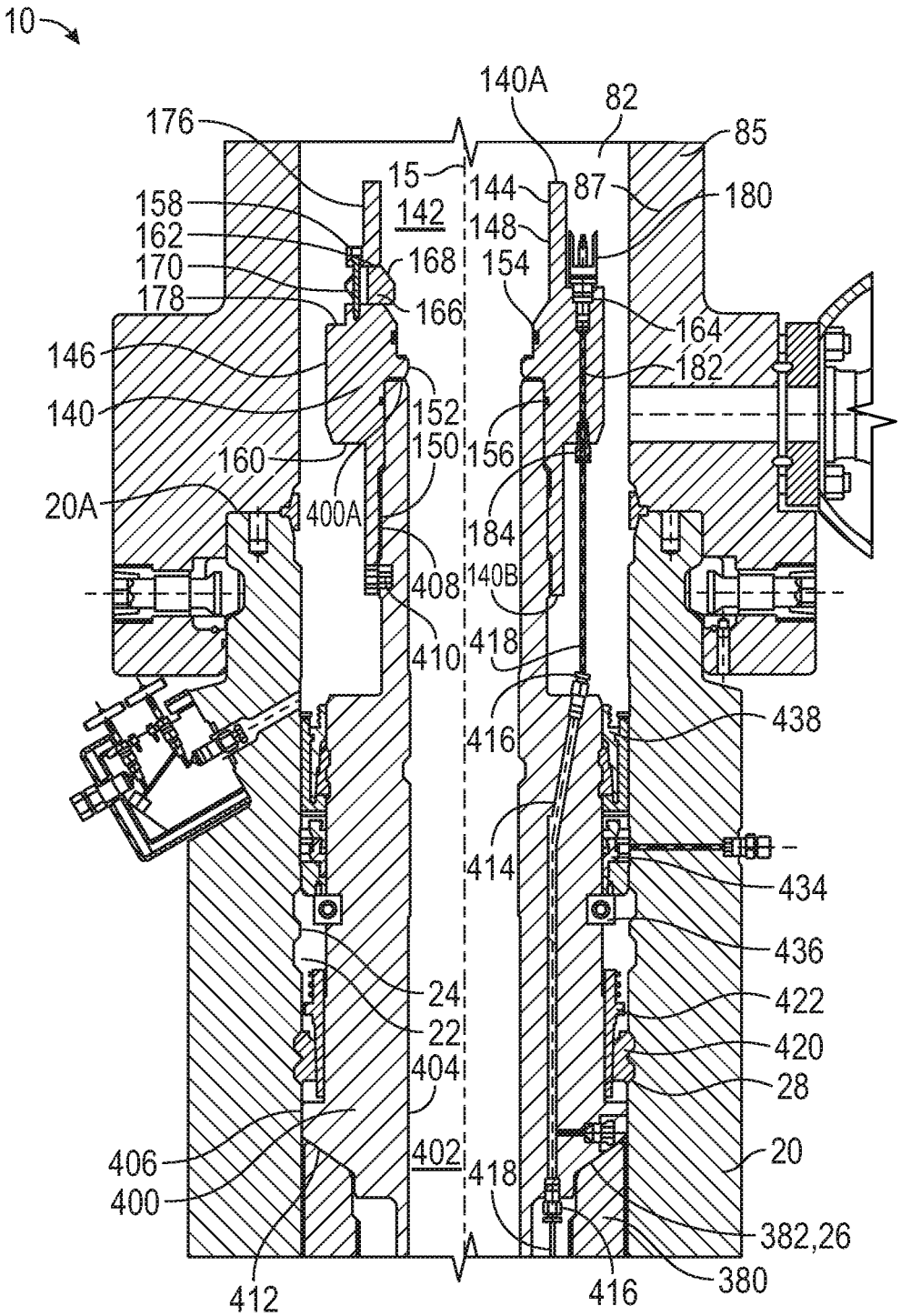
FIG. 10 is a cross-sectional view of the running tool assembly of FIG. 2 shown in a fifth position in the wellhead assembly of the well system of FIG. 1.

As shown particularly in FIGS. 8-10, following the locking of tubing hanger 400 in wellhead housing 20 and the performance of any other desired downhole operations, inner body 102 and outer body 200 may be decoupled from tubing hanger 400 and removed from wellhead housing 20 to allow for the installation of an annular seal assembly 434 (shown in FIG. 10) radially between the inner surface 24 of wellhead housing 20 and the outer surface 406 of tubing hanger 400. Particularly, in the embodiment shown in FIGS. 6-12, conveyance string 90 is rotated (indicated by arrow 450 in FIG. 8) about the longitudinal axis 15 of well system 10 via a torque application mechanism (e.g., a rotary table, top drive, etc.) at the rig or platform from which conveyance string 90 is suspended. Rotation of conveyance string 90 is transferred to inner body 102 via the connection formed between connectors 92 and 110, respectively, causing the threaded connector 116 of inner body 102 to unthread or disconnect from the threaded connector 148 of control line sub 140.

As the inner body 102 unthreads from control line sub 140, inner body 102 moves or translates axially upwards relative to control line sub 140, causing the annular groove 118 of inner body 102 to axially align with the plurality of circumferentially spaced locking dogs 166 of control line sub 140. As the inner body 102 is continuously rotated relative control line sub 140 (held stationary by the sub 140's coupling with the locked tubing hanger 400), the connector 116 of inner body 102 will eventually breakout or completely unthread from the connector 148 of control line sub 140, at which point the conveyance string 90 may be retracted upwards towards the rig or platform from which it is suspended and away from wellhead housing 20. As the conveyance string 90 is retracted upwards, the inner body 102 coupled thereto is displaced axially upwards relative control line sub 140, causing the outer shoulder 114 of inner body 102 to engage the inner shoulder 208 of outer body 200, urging outer body 200 axially upwards along with inner body 102 and conveyance string 90. As shown particularly in FIG. 9, the upwards axial force applied to outer body 200 by inner body 102 is translated into a radially inwards force applied to locking dogs 166 via the engagement at the angled interface between the angled inner profile 220 of engagement tabs 216 of outer body 200 and corresponding angled outer profile 170 of locking dogs 166, urging or actuating locking dogs 166 into the inner unlocked position that provides for relative axial movement between outer body 200 and control line sub 140.

With locking dogs 166 actuated into the inner unlocked position, continued upwards retraction of conveyance string 90 carries inner body 102 and outer body 200 of running tool assembly 100 therewith towards the rig or platform from which conveyance string 90 is suspended. As outer body 200 travels upward in concert with conveyance string 90 and inner body 102, the male connectors 226 of outer body 200 releasably disconnects from the female connectors 180 of control line sub 140. In this manner, string 90, inner body 102, and outer body 200 are retrieved from wellhead housing 20 while control line sub 140 remains coupled or attached with tubing hanger 140, with female connectors 180 of sub 140 in signal communication with control lines 418 of tubing hanger 400. Female connectors 180 of control line sub 140 are not damaged by the disconnection of male connectors 226 of outer body 200, and may connect with other corresponding male stab connectors positioned into engagement therewith.

As shown particularly in FIG. 10, following retrieval of inner body 102 and outer body 200 of running tool assembly 100, a separate running tool (not shown) is run into the bore 22 of wellhead housing 20 to seat seal assembly 434 on a carrier ring 436 coupled to tubing hanger 400. In the embodiment shown in FIGS. 6-12, once the seal assembly 434 is seated within bore 22 of wellhead housing 20, an actuation or energizing member 438 is actuated by the application of an axial load provided by the running tool to energize the seal assembly 434 and thereby seal the annulus formed between the inner surface 24 of wellhead housing 20 and the outer surface 406 of tubing hanger 400. In some embodiments, a running tool similar in configuration to running tool assembly 100 may be used to seat and energize seal assembly 434 in bore 22 of wellhead housing 200. In some embodiments, seal assembly 434 may be energized via the application of hydraulic pressure or via the application of rotational torque to actuation member 438 in lieu of the application of an axially directed load to actuation member 438. In certain embodiments, the running tool used for installing seal assembly 434 may include one or more control lines equipped with stab connectors for mating with the female stab connectors 180 of control line sub 140, thereby allowing for the transmission of control signals downhole during the installation of seal assembly 434.

Figure 11:
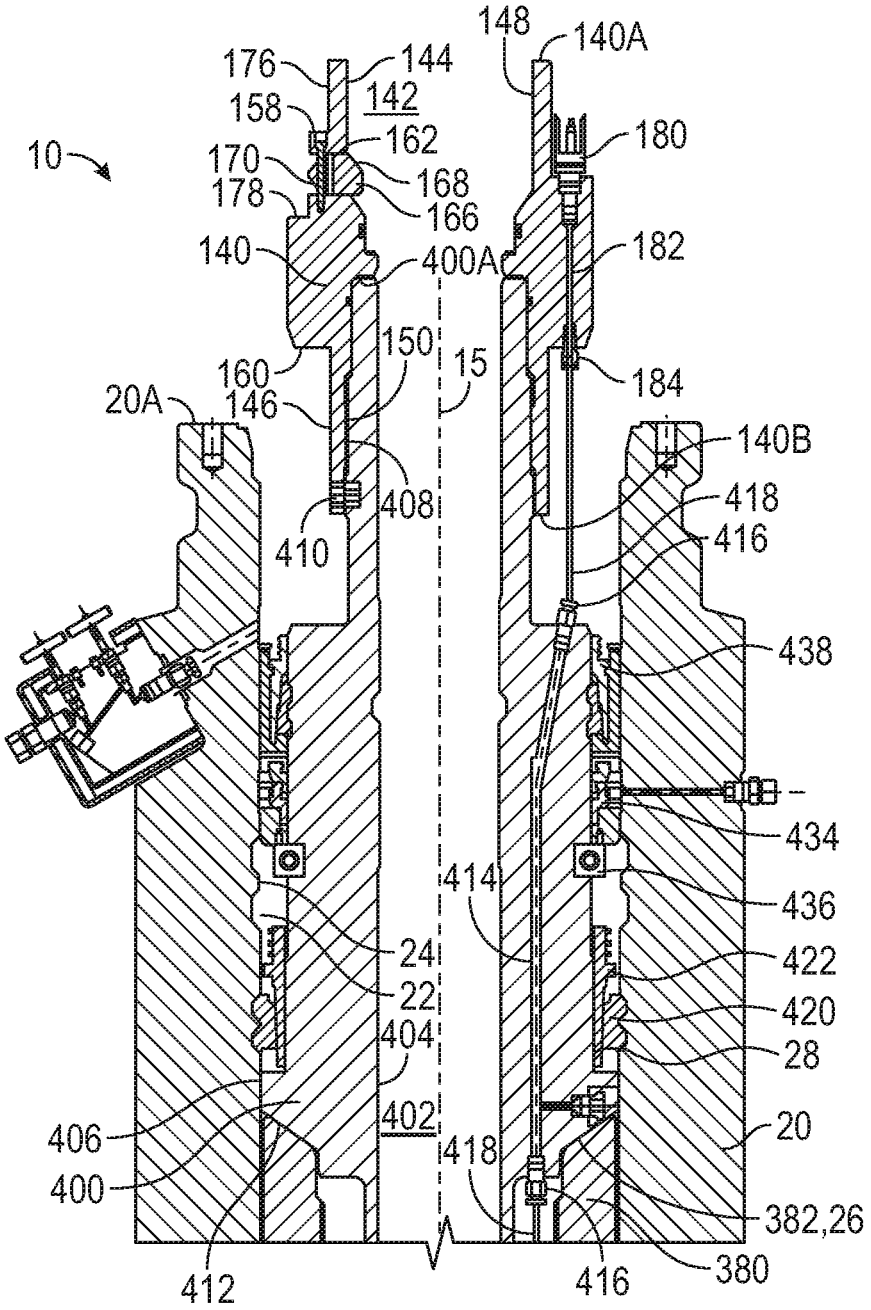
FIG. 11 is a cross-sectional view of the running tool assembly of FIG. 2 shown in a sixth position in the wellhead assembly of the well system of FIG. 1.
Figure 12:
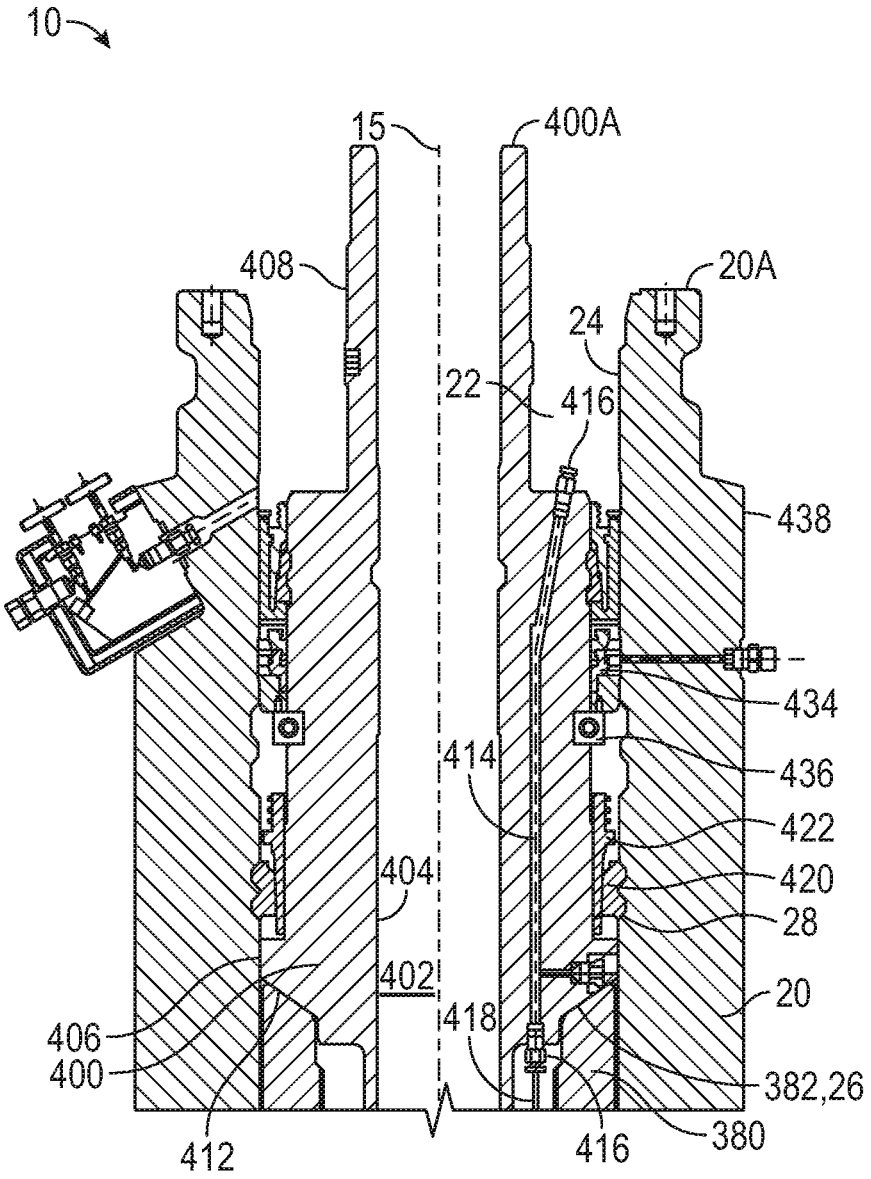
FIG. 12 is a cross-sectional view of the running tool assembly of FIG. 2 shown in a seventh position in the wellhead assembly of the well system of FIG. 1.

As shown particularly in FIGS. 11 and 12, following the installation of seal assembly 434 in wellhead housing 20, the completion of well system 10 is continued or finalized with the removal of riser and BOP assembly 85 and the installation of a Christmas or production tree atop wellhead housing 20, where the production tree is configured to route hydrocarbons produced from formation 6 and transported through production tubing 500 to other components of well system 10 for processing and transport. As shown in FIG. 11, riser and BOP assembly 85 (including both riser 87 and BOP 80) is disconnected from wellhead housing 20 and retrieved to the rig or platform of well system 10, thereby exposing control line sub 140, which projects axially from the upper end 20A of wellhead housing 20. With the removal of riser and BOP assembly 85, the lower end 140B of control line sub 140 is exposed, allowing for the removal of coupling members 410 that restrict relative rotation between control line sub 140 and tubing hanger 140. In this embodiment, coupling members 410 are removed by hand from control line sub 140; however, in other embodiments, members 410 may be removed via other means. Additionally, following the removal of riser and BOP assembly 85, control lines 418 are removed from control line sub 140. In some embodiments, control lines 418 are passed through and terminated in wellhead housing 20.

In the embodiment shown in FIGS. 6-12, lifting eyes (not shown) are coupled to control line sub 140 and torque is applied to sub 140 through the attached lifting eyes, thereby unthreading control line sub 140 from the threaded connector 408 of tubing hanger 400. As described above, removal of the coupling members 410 permits the relative rotation and unthreading of control line sub 140 from tubing hanger 400 in response to the application of torque from the conveyance string. In other embodiments, other mechanisms known in the art other than lifting eyes may be attached to control line sub 140 to provide for the transmission of torque to sub 140. Following the decoupling of control line sub 140 from tubing hanger 400, the lifting eyes and control line sub are retracted to the rig or platform of well system 10. Once control line sub 140 is removed from tubing hanger 400, exposing the upper end 400A of tubing hanger 400 to the surrounding environment, the production tree is installed over the exposed upper end 400A of tubing hanger 400 and coupled to wellhead housing 20 to provide for the production of hydrocarbons from the formation 6 shown in FIG. 1.

Figure 13:
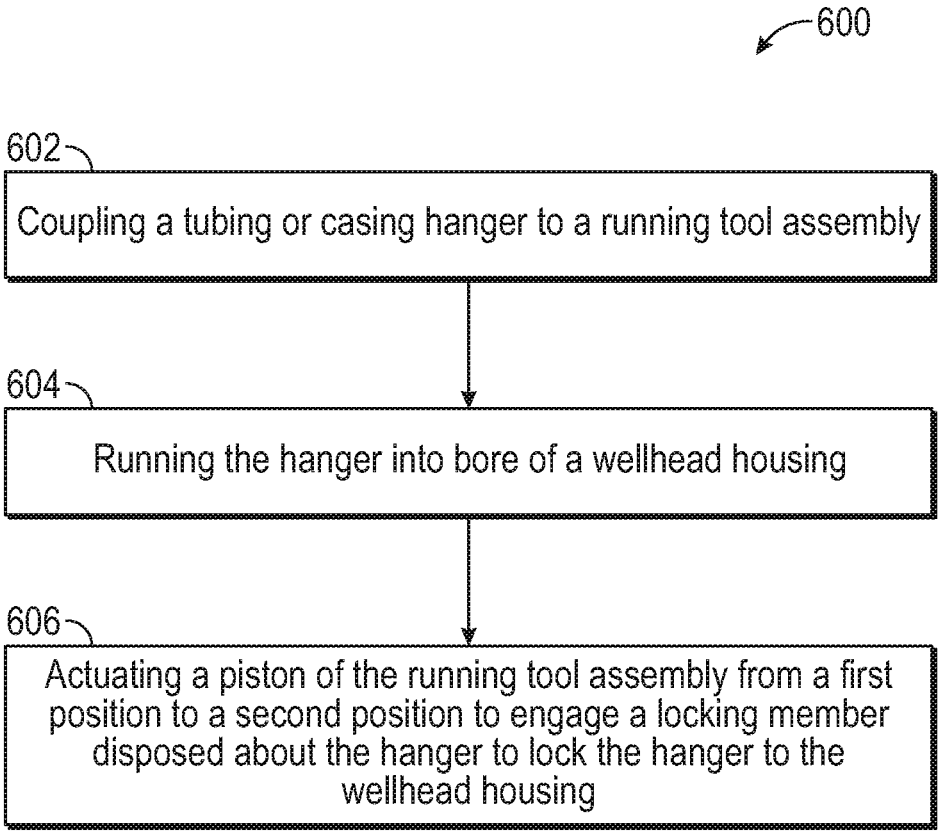
FIG. 13 is a flowchart illustrating an embodiment of a method for installing a tubing or casing hanger in a wellhead housing in accordance with principles disclosed herein.

Referring to FIGS. 1, 2, and 6-13, a flowchart of an embodiment of a method 600 for installing a tubing or casing hanger in a wellhead housing is shown in FIG. 13. At block 602 of method 600, a tubing or casing hanger is coupled to a running tool assembly. In some embodiments, block 602 comprises coupling tubing hanger 400 to running tool assembly 100, such as by threading connector 408 of tubing hanger 400 to the lower connector 150 of control line sub 140. At block 604 of method 600, the tubing or casing hanger is run into a bore of a wellhead housing. In some embodiments, block 604 comprises running the tubing hanger 500 into the bore 22 of wellhead 20 using conveyance string 90. In other embodiments, block 604 may comprise lowering tubing hanger 400 into wellhead housing 20 using a crane, lifting eyes, or other lifting device. In some embodiments, production tubing 500 is coupled to tubing hanger 400 when tubing hanger 400 is lowered into wellhead housing 20. At block 606 of method 600, a piston of the running tool assembly is actuated from a first position to a second position to engage a locking member disposed about the hanger to lock the hanger to the wellhead housing. In certain embodiments, block 606 comprises actuating or displacing the actuation piston 300 from the first position shown in FIG. 6 to the second position shown in FIG. 7 to actuate lock ring 420 into the locked position thereby locking the tubing hanger 400 to the wellhead housing 20.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A running tool assembly for installing a tubing or casing hanger in a wellhead housing, comprising:

a first body configured to support the tubing or casing hanger;

a second body releasably coupled to the first body;

an actuation piston axially moveable relative to the second body, wherein the piston comprises a first position and a second position axially spaced from the first position;

a piston chamber formed in the running tool assembly; and a control line sub engaged with the second body;

wherein, when the running tool assembly is coupled to the tubing or casing hanger and the hanger is positioned in the wellhead housing, the actuation piston is configured to actuate from the first position to the second position in response to a pressurization of the piston chamber to engage a locking member disposed about the tubing or casing hanger and thereby lock the tubing or casing hanger to the wellhead housing;

wherein the running tool assembly comprises a central passage having a minimum diameter that is equal to or larger in size than a minimum diameter of a central passage of the tubing or casing hanger; and wherein the first body is displaced axially relative to the second body to, in turn, enable displacement of a locking member of the control line sub from a locked position to an unlocked position, thus permitting relative axial movement between the second body and the control line sub.

2. The running tool assembly of claim 1, wherein:

the first body comprises an inner body configured to couple with a conveyance string configured to transport the running tool assembly; and the second body comprises an outer body disposed about the inner body.

3. The running tool assembly of claim 2, further comprising:

an actuation flange coupled to the outer surface of the outer body;

wherein the actuation piston comprises a radially inwards extending flange that includes a seal in sealing engagement with the outer surface of the outer body;

wherein the piston chamber is formed between a lower end of the actuation flange and the flange of the actuation piston.

4. The running tool assembly of claim 3, further comprising an actuation passage extending through the outer body and in fluid communication with the piston chamber, wherein the actuation passage is configured to receive pressurized fluid from an actuation control line to actuate the actuation piston from the first position to the second position.

5. The running tool assembly of claim 2, further comprising a control line flange coupled to the inner body, wherein the control line flange is configured to releasably couple to the tubing or casing hanger.

6. The running tool assembly of claim 1, further comprising:

a control line stab connector housed in the running tool assembly;

wherein, when the running tool assembly is coupled to the tubing or casing hanger, the running tool assembly is configured to transmit control signals between a first control line coupled to the running tool assembly and a second control line coupled to the tubing or casing hanger via the control line stab connector.

7. A running tool assembly for installing a tubing or casing hanger in a wellhead housing, comprising:

a first body configured to support the tubing or casing hanger;

a second body releasably coupled to the first body;

a control line sub to which is mounted a control line stab connector housed in the running tool assembly, the control line sub initially being secured to the second body by a releasable control line sub lock to prevent disconnection of the control line stab connector until release of the control line sub lock;

an actuation piston axially moveable relative to the second body, wherein the piston comprises a first position and a second position axially spaced from the first position; and a piston chamber formed in the running tool assembly;

wherein, when the running tool assembly is coupled to the tubing or casing hanger and the hanger is positioned in the wellhead housing, the actuation piston is configured to actuate from the first position to the second position in response to a pressurization of the piston chamber to engage a locking member disposed about the tubing or casing hanger and thereby lock the tubing or casing hanger to the wellhead housing;

wherein, when the running tool assembly is coupled to the tubing or casing hanger, the running tool assembly is configured to transmit control signals between a first control line coupled to the running tool assembly and a second control line coupled to the tubing or casing hanger via the control line stab connector.

8. The running tool assembly of claim 7, wherein the control line stab connector comprises:

a male stab connector coupled to the second body; and a female stab connector coupled to the control line sub;

wherein the male and female stab connectors are configured to connect and form a signal connection therebetween in response to the application of an axial load to one of the male or female stab connectors.

9. The running tool assembly of claim 8, wherein:

the second body comprises a control passage having a first end including a fitting configured to couple with the first control line and a second end including the male stab connector; and the control line sub comprises a control passage having a first end including the female stab connector and a second end including a fitting configured to couple with the second control line.

10. The running tool assembly of claim 8, wherein in response to disconnecting the second body from the control line sub, the male stab connector of the second body is configured to disconnect from the female stab connector of the control line sub.

11. The running tool assembly of claim 7, wherein:

the first body comprises an inner body configured to couple with a conveyance string configured to transport the running tool assembly; and the second body comprises an outer body disposed about the inner body.

12. The running tool assembly of claim 11, further comprising:

an actuation flange coupled to the outer surface of the outer body;

wherein the actuation piston comprises a radially inwards extending flange that includes a seal in sealing engagement with the outer surface of the outer body;

wherein the piston chamber is formed between a lower end of the actuation flange and the flange of the actuation piston.

13. The running tool assembly of claim 12, further comprising an actuation passage extending through the outer body and in fluid communication with the piston chamber, wherein the actuation passage is configured to receive pressurized fluid from an actuation control line to actuate the actuation piston from the first position to the second position.

14. The running tool assembly of claim 7, wherein the running tool assembly comprises a central passage having a minimum diameter that is equal to or larger in size than a minimum diameter of a central passage of the tubing or casing hanger.

15. A method of installing a tubing or casing hanger in a wellhead housing, comprising:

coupling the tubing or casing hanger to a running tool assembly;

running the tubing or casing hanger into a bore of a wellhead housing; and actuating a piston of the running tool assembly from a first position to a second position axially spaced from the first position to engage a locking member disposed about the tubing or casing hanger and thereby lock the tubing or casing hanger to the wellhead housing;

wherein the running tool assembly comprises a central passage having a minimum diameter that is as great or larger in size than a minimum diameter of a central passage of the tubing or casing hanger; and axially displacing an inner body of the running tool assembly relative to an outer body of the running tool assembly;

whereby axially displacing the inner body relative to the outer body displaces a locking member of a control line sub of the running tool assembly from a locked position to an unlocked position, permitting relative axial movement between the outer body and the control line sub.

16. The method of claim 15, further comprising pressurizing an actuation control line coupled to the running tool assembly to pressurize a piston chamber of the running tool assembly and actuate the piston from the first position to the second position.

17. The method of claim 15, further comprising:

disconnecting an outer body of the running tool assembly from a control line sub of the running tool assembly;

whereby disconnecting the outer body from the control line sub disconnects a male stab connector of the outer body from a female stab connector of the control line sub.

* * * * *